US009347657B2

(12) United States Patent
Chiang

(10) Patent No.: US 9,347,657 B2
(45) Date of Patent: May 24, 2016

(54) LED CHRISTMAS LAMP STRUCTURE

(71) Applicant: Cheng-Yao Chiang, Hsinchu (TW)

(72) Inventor: Cheng-Yao Chiang, Hsinchu (TW)

( * ) Notice: Subject to any disclaimer, the term of this patent is extended or adjusted under 35 U.S.C. 154(b) by 0 days.

(21) Appl. No.: 14/702,751

(22) Filed: May 3, 2015

(65) Prior Publication Data

US 2015/0233562 A1 Aug. 20, 2015

Related U.S. Application Data

(63) Continuation-in-part of application No. 13/668,330, filed on Nov. 5, 2012, now abandoned.

(51) Int. Cl.

| | |
|---|---|
| ***F21V 23/00*** | (2015.01) |
| ***F21S 4/00*** | (2016.01) |
| ***F21S 10/06*** | (2006.01) |
| ***F21S 10/02*** | (2006.01) |
| *F21Y 103/00* | (2016.01) |
| *F21W 121/04* | (2006.01) |

(52) U.S. Cl.

CPC ..... *F21V 23/005* (2013.01); *F21S 4/001* (2013.01); *F21S 10/023* (2013.01); *F21S 10/06* (2013.01); *F21V 23/002* (2013.01); *F21W 2121/04* (2013.01); *F21Y 2103/003* (2013.01)

(58) Field of Classification Search

CPC ..... F21S 4/001; F21S 4/10; F21V 33/008; A47G 33/04

USPC ..... 362/654

See application file for complete search history.

(56) References Cited

U.S. PATENT DOCUMENTS

| | | | | |
|---|---|---|---|---|
| 7,575,362 | B1 * | 8/2009 | Hsu | H01R 33/09 362/647 |
| 2011/0122613 | A1 * | 5/2011 | Hsu | F21V 19/0005 362/231 |

* cited by examiner

*Primary Examiner* — Karabi Guharay

(74) *Attorney, Agent, or Firm* — Leong C. Lei

(57) ABSTRACT

An LED Christmas lamp includes a lamp base, in which a receiving cavity is formed and having coupling slots formed in a cavity wall to receive and retain metal plates on ends of four conductive wires. A light source holder has a top forming a light disposition section, in which three receiving holes are formed and has a bottom on which a fitting section having four bearing surfaces is formed. The fitting section has a bottom face including six through apertures. Three LED illuminants are provided, each having two terminal pins, and are respectively inserted into the three receiving holes with the terminal pins bent and positioned against the bearing surfaces of the fitting section so that when the light source holder is inserted into the receiving cavity, the terminal pins are set in electrical engagement with the metal plates of the conductive wires.

12 Claims, 4 Drawing Sheets

LED CHRISTMAS LAMP STRUCTURE

CROSS-REFERENCE TO RELATED APPLICATION

This is a continuation-in-part of co-pending U.S. patent application Ser. No. 13/668,330 filed on Nov. 5, 2012 and owned by the present applicant.

BACKGROUND OF THE INVENTION (a) Technical Field of the Invention

The present invention generally relates to an improved structure of LED Christmas lamp, and more particularly to an improvement of an individual lamp unit of a Christmas lamp string.

(b) Description of the Prior Art

The term "Christmas lamp string" used herein is referred to a type of lamp string that twinkles and flashes and comprises individual light sources made up of LEDs. The twinkling of the Christmas lamp strings can be of two types, one being simply twinkling between light and dark and the other being alternately twinkling among various color lights. For LED Christmas lamps, those capable of switching among various colors would definitely be the main stream of market. Heretofore, the alternate twinkling function of this type of LED lamp string is controlled by a control box mounted to the lamp string and the control is achieved by conductor wires extending from the control box and connected to each light source of the lamp string with two contact terminals that form a circuit. The control case contains therein an integrated circuit (IC), in which a twinkling mode is loaded so that the entire lamp string will be controlled to do the same pattern of color light twinkling. Such twinkling operation is remarkable. However, in view of the functionality of an LED light source, it would be possible to further upgrade the alternate color twinkling of light. Thus, the present invention aims to provide further improvements in this respect.

SUMMARY OF THE INVENTION

The primary object of the present invention is to provide an improved Christmas lamp structure that is embodied in an LED Christmas lamp string having a twinkling effect of alternating and switching various colors of light, whereby each Christmas lamp of the LED lamp string is operated in an individual and independent pattern of twinkling for alternating and switching among various colors of light so as to provide the LED lamp string with diversified twinkling effects of color changing.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
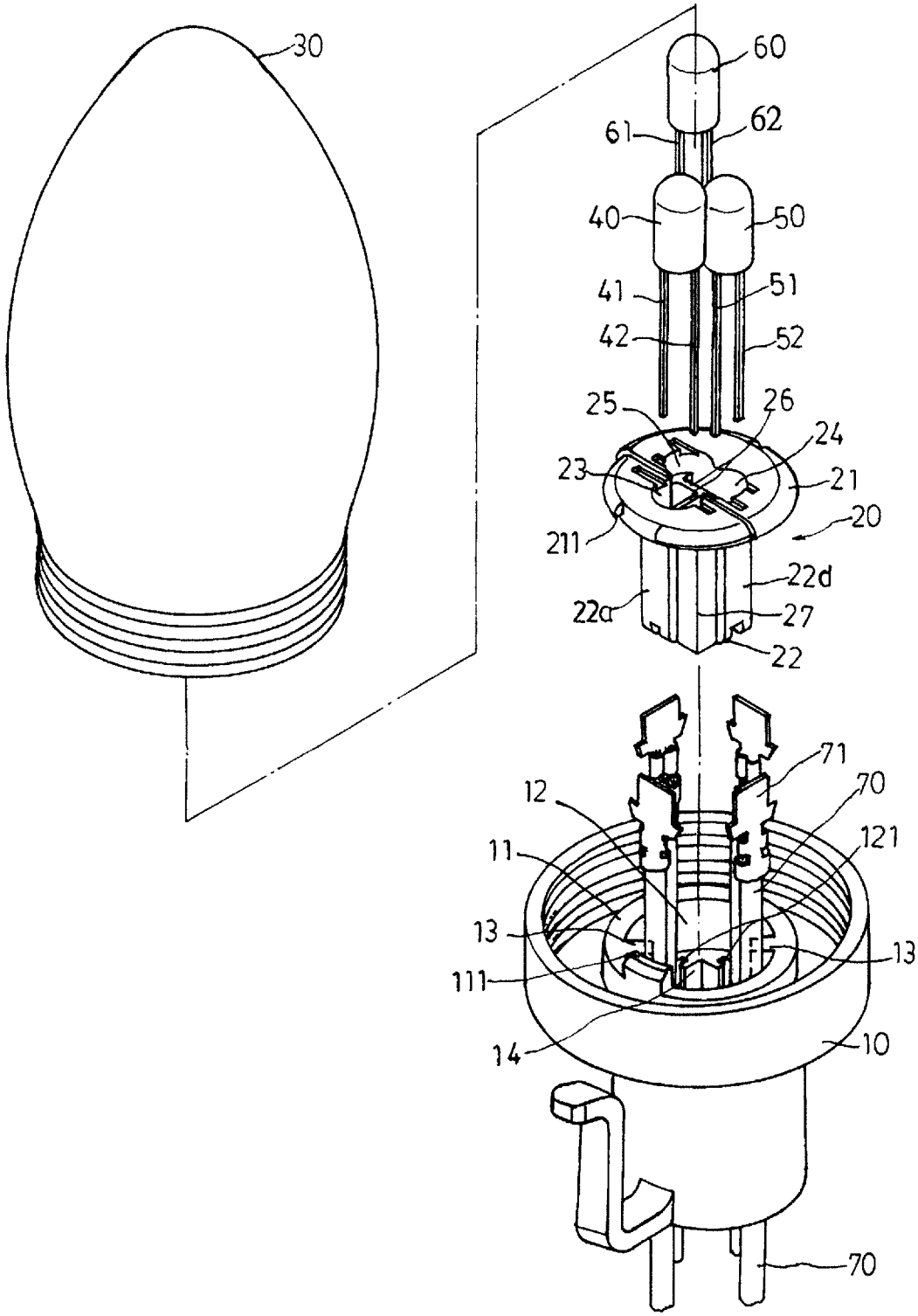
FIG. 1 is an exploded view showing a structure according to the present invention.
Figure 4:
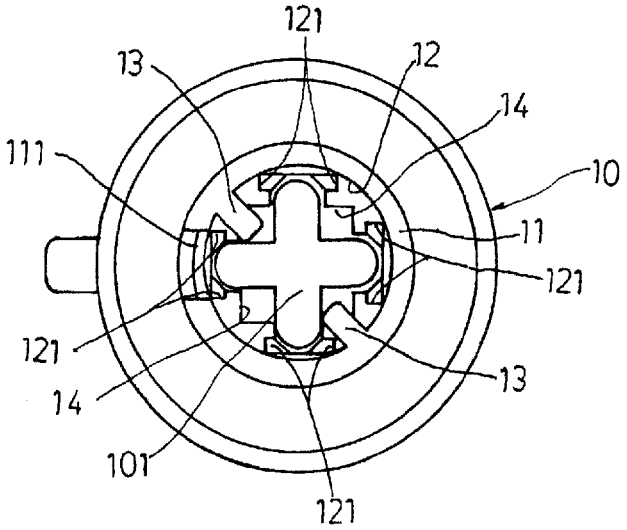
FIG. 4 is a top plan view showing a lamp base of the present invention.
Figure 6:
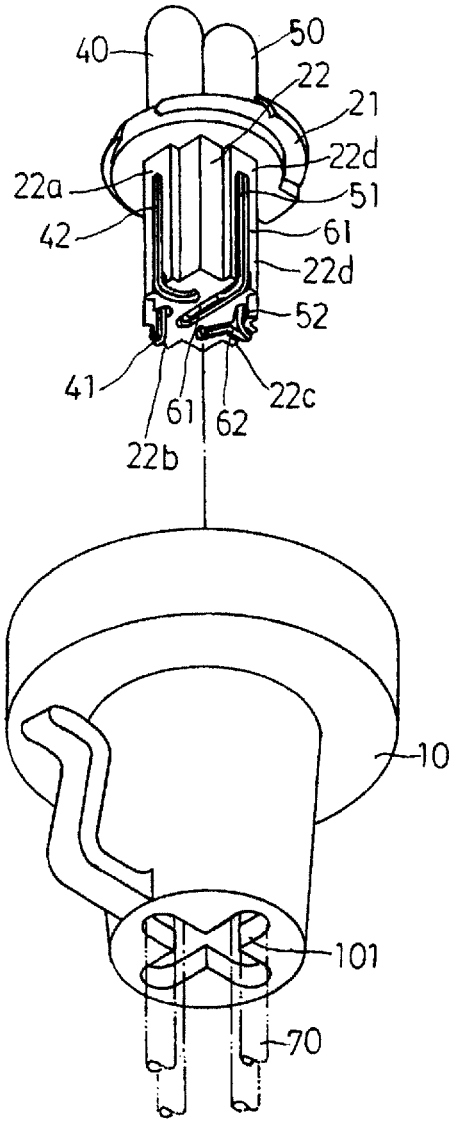
FIG. 6 is an exploded view, taken from the bottom side, of the structure of the present invention.
Figure 7:
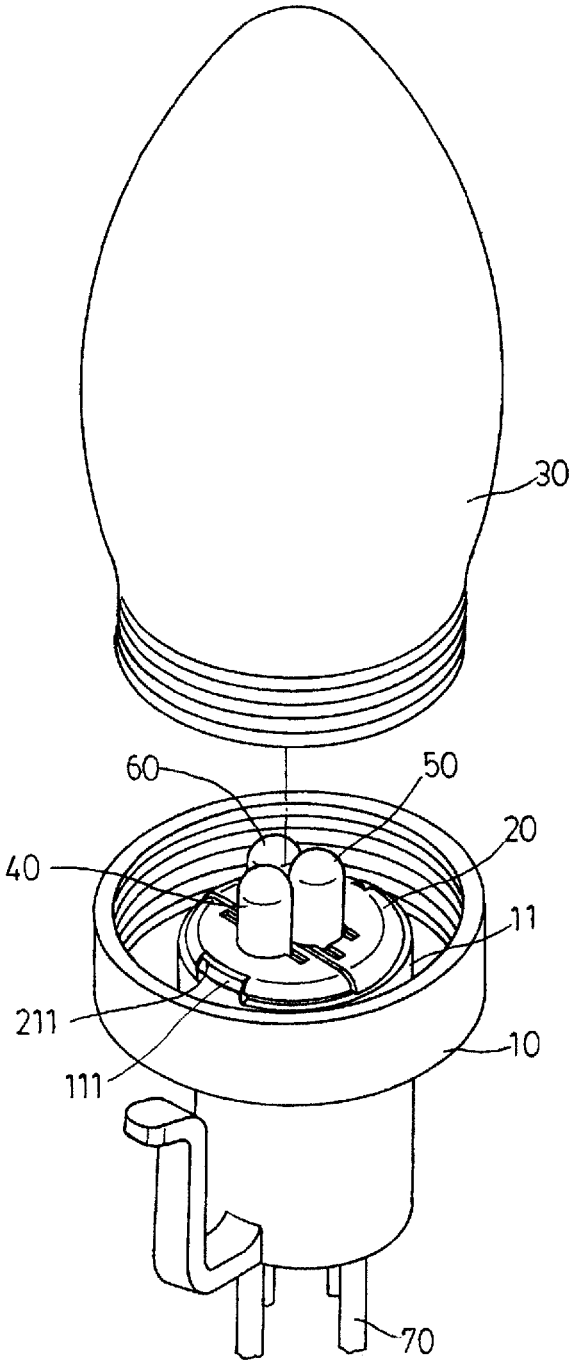
FIG. 7 is a schematic view illustrating assembly of the structure of the present invention.

Referring to the drawings, a light-emitting diode (LED) Christmas lamp structure according to the present invention is generally made up of components including a lamp base (10), a light source holder (20), a lamp shell (30), and three LED illuminants (40), (50), (60). As shown in FIGS. 1, 4, and 6, the lamp base (10) has a top end that is open and comprises a receptacle (11) formed in a central portion thereof. The receptacle (11) comprises a receiving cavity (12) formed therein. The receiving cavity (12) has a lower end in which a wire hole (101) having a cruciform configuration is formed and a cavity wall in which a coupling slot (121) is formed to correspond to each of four ends of the cruciform wire hole (101) and also comprises a positioning rib (13) arranged between two adjacent ones of the coupling slots (121) and an additional positioning rib (13) arranged between two adjacent ones of the coupling slots (121) that are at an opposite location and also comprises a positioning channel (14) formed therein between two adjacent ones of the coupling slots (121) where no such rib is arranged and an additional positioning channel (14) formed between two adjacent ones of the coupling slots (121) at an opposite location. Further, the receptacle (11) has a top rim on which an alignment block (111) is formed. The lamp base (10) has a bottom end through which four conductive wires (70), which constitute in part a lamp string and each of which has an end to which a metal plate (71) is fixed, are allowed to extend in such a way that the metal plates (71) of the conductive wires (70) are respectively received and retained in the coupling slots (121) formed in the cavity wall of the receiving cavity (12).

Figure 2:
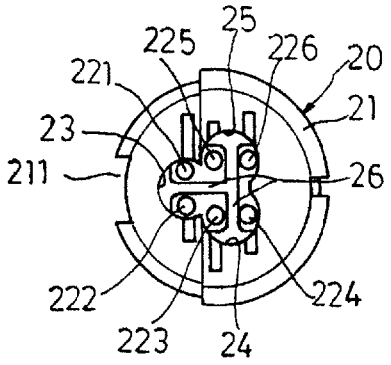
FIG. 2 is a top plan view showing a light source holder of the present invention.
Figure 3:
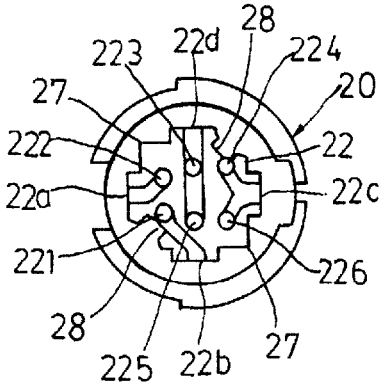
FIG. 3 is a bottom plan view of the light source holder of the present invention.
Figure 5:
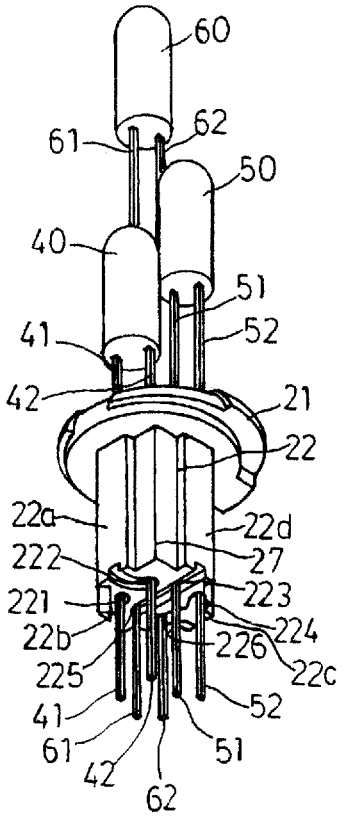
FIG. 5 is a schematic view illustrating a spatial relationship between the light source holder and LED illuminants of the present invention.

As shown in FIGS. 1, 3, and 5, the light source holder (20) has a top that forms a light disposition section (21) in the form of a plate or disc and comprises three receiving holes (23), (24), (25) formed therein. The light disposition section (21) has a circumference in which an alignment notch (211) is formed at a position corresponding to the alignment block (111) formed in the top rim of the receptacle (11) of the lamp base (10). The light disposition section (21) has a bottom on which a square box like fitting section (22) is formed. The fitting section (22) has four sides forming four bearing surfaces (22*a*), (22*b*), (22*c*), (22*d*) respectively corresponding to the four ends of the cruciform wire hole (101) of the lamp base (10). The fitting section (22) has a bottom face in which six through apertures (221), (222), (223), (224), (225), (226) are formed in such a way that the six through apertures are all located in an area covered by the three receiving holes (23), (24), (25). Separation boards (26) are arranged to separate the six through apertures into three pairs (as shown in FIG. 2). Further, as shown in FIG. 3, in the bottom face of the fitting section (22), the through aperture (221) comprises a passage extending therefrom to an opening formed in the bearing surface (22*b*); the through aperture (222) comprises a passage extending therefrom to an opening formed in the bearing surface (22*a*); the through apertures (223), (225) are collectively provided with a passage extending therefrom to an opening formed in the bearing surface (22*d*); and the through apertures (224), (226) are each provided with a passage extending therefrom to a common opening formed in the bearing surface (22*c*).

As shown in FIGS. 3 and 5, the fitting section (22) of the light source holder (20) comprises a mating edge corner (27) between the bearing surfaces (22*a*), (22*d*) to correspond, in shape and position, to the positioning channel (14) of the lamp base (10) and also comprises an additional mating edge corner (27) between the bearing surfaces (22*b*), (22*c*) at the opposite location to corresponding, in shape and position, to the positioning channel (14) of the lamp base (10) and also comprises an elongate groove (28) formed therein between the bearing surfaces (22*a*), (22*b*) to correspond, in shape and position, to the positioning rib (13) of the lamp base (10) and also comprises an elongate groove (28) therein between the bearing surfaces (22*c*), (22*d*) to correspond, in shape and position, to the positioning rib (13) of the lamp base (10).

Referring to FIGS. 1, 2, 3, and 5, the LED illuminant (40) has a lower end on which two terminal pins (41), (42) are mounted; the LED illuminant (50) has a lower end on which two terminal pins (51), (52) are mounted; the LED illuminant (60) has a lower end on which two terminal pins (61), (62) are mounted. The LED illuminants (40) is inserted into the receiving hole (23) of the light source holder (20) with the terminal pin (41) extending through the through aperture (221) and the terminal pin (42) extending through the through aperture (222); the LED illuminant (50) is inserted into the receiving hole (24) of the light source holder (20) with the terminal pin (51) extending through the through aperture (223) and the terminal pin (52) extending through the through aperture (224); and the LED illuminant (60) is inserted into the receiving hole (25) of the light source holder (20) with the terminal pin (61) extending through the through aperture (225) and the terminal pin (62) extending through the through aperture (226). As shown in FIG. 6, the terminal pin (41) of the LED illuminant (40) is bent and received in the passages so as to be positioned against the bearing surface (22*b*) of the fitting section (22) and the terminal pin (42) is bent and received in the passages to be positioned against the bearing surface (22*a*) of the fitting section (22); the terminal pin (51) of the LED illuminant (50) is bent and received in the passages to be positioned against the bearing surface (22*d*) of the fitting section (22) and the terminal pin (52) is bent and received in the passages to be positioned against the bearing surface (22*c*) of the fitting section (22); and the terminal pin (61) of the LED illuminant (60) is bent and received in the passages to be positioned against the bearing surface (22*d*) of the fitting section (22) and the terminal pin (62) is bent and received in the passages to be positioned against the bearing surface (22*c*) of the fitting section (22).

The light source holder (20) is inserted into the receiving cavity (12) of the lamp base (10) and the two elongate grooves (28) of the fitting section (22) of the light source holder (20) are respectively fit to and mate with the two positioning ribs (13) of the receiving cavity (12) of the lamp base (10) and the two mating edge corners (27) of the fitting section (22) of the light source holder (20) are respectively fit to and mate with the two positioning channels (14) of the receiving cavity (12) of the lamp base (10). Further, the alignment block (111) of the receptacle (11) of the lamp base (10) and the alignment notch (211) of the light disposition section (21) of the light source holder (20) the receptacle (11) are fit to and engage with each other. The terminal pins that are bent and positioned against the four bearing surfaces of the fitting section (22) of the light source holder (20) are set in tight engagement and thus electrically connected to the four metal plates (71) of the conductive wires (70). Finally, the lamp shell (30) is coupled to the lamp base (10) to house the LED illuminants to provide an LED Christmas lamp that is capable of independent alternating twinkling of light.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A light-emitting diode (LED) Christmas lamp, comprising a lamp base, a light source holder, three LED illuminants, and a lamp shell, wherein the lamp base comprises a receiving cavity formed therein and the lamp base has a bottom through which four conductive wires of a lamp string extend in such a way that metal plates mounted to ends of the conductive wires are respectively received and retained in coupling slots formed in four sides of a cavity wall of the receiving cavity; wherein the light source holder has a top forming a plate like light disposition section, in which three receiving holes are formed, and the light disposition section has a bottom on which a fitting section that has four sides each forming a bearing surface is formed, the fitting section having a bottom face in which six through apertures are formed; wherein the LED illuminants each have a lower end on which two terminal pins are mounted and the three LED illuminants are respectively inserted into the three receiving holes of the light source holder in such a way that the terminal pins of the three LED illuminants are bent and positioned against the bearing surfaces of the four sides of the fitting section; and wherein the light source holder is inserted into the receiving cavity of the lamp base in such a way that the terminal pins positioned against the bearing surfaces of the four sides of the fitting section are respectively set in engagement with and thus electrically connected to the four metal plates of the conductive wires, the lamp shell being coupled to the lamp base to house the three LED illuminants, whereby an LED Christmas lamp that is capable of independent alternating twinkling of light is formed.

2. The LED Christmas lamp according to claim 1, wherein the lamp base has a top that is open and comprises a receptacle formed in a central portion thereof, the receiving cavity being formed in the receptacle, the receiving cavity having a lower end in which a wire hole having a cruciform configuration is formed, the coupling slots being formed in the cavity wall of receiving cavity to respectively correspond to four ends of the cruciform wire hole four.

3. The LED Christmas lamp according to claim 2, wherein the receiving cavity of the lamp base comprises a positioning rib formed therein between two adjacent ones of the coupling slots and also comprises an additional positioning rib formed therein between two adjacent ones the coupling slots at an opposite location and also comprises a positioning channel formed therein between adjacent ones of the coupling slots and also comprises an additional positioning channel formed therein between two adjacent ones of the coupling slots at an opposite location.

4. The LED Christmas lamp according to claim 2, wherein the receptacle of the lamp base has a top rim on which an alignment block is formed.

5. The LED Christmas lamp according to claim 1, wherein the receiving cavity of the lamp base comprises a positioning rib formed therein between two adjacent ones of the coupling slots and also comprises an additional positioning rib formed therein between two adjacent ones the coupling slots at an opposite location and also comprises a positioning channel formed therein between adjacent ones of the coupling slots and also comprises an additional positioning channel formed therein between two adjacent ones of the coupling slots at an opposite location.

6. The LED Christmas lamp according to claim 1, wherein a receptacle of the lamp base has a top rim on which an alignment block is formed.

7. The LED Christmas lamp according to claim 1, wherein the fitting section formed on the bottom of the light disposition section of the light source holder has a square box like configuration that has the four sides corresponding to ends of a cruciform wire hole formed in the lamp base and respectively forming the four bearing surfaces and the six through holes are formed in the bottom of the fitting section in such a way that the six through apertures are located in an area covered by the three receiving holes.

8. The LED Christmas lamp according to claim 7, wherein the light disposition section of the light source holder has a circumference in which an alignment notch is formed to correspond in position to an alignment block on the top rim of a receptacle of the lamp base.

9. The LED Christmas lamp according to claim 7, wherein the light disposition section of the light source holder comprises separation boards to separate the six through apertures into three pairs.

10. The LED Christmas lamp according to claim 1, wherein the light disposition section of the light source holder has a circumference in which an alignment notch is formed to correspond in position to an alignment block on the top rim of a receptacle of the lamp base.

11. The LED Christmas lamp according to claim 1, wherein the light disposition section of the light source holder comprises separation boards to separate the six through apertures into three pairs.

12. The LED Christmas lamp according to claim 1, wherein the fitting section of the light source holder comprises a mating edge corner formed between two adjacent ones of the bearing surfaces to correspond in shape and position to a positioning channel of the lamp base and also comprises an additional mating edge corner formed between adjacent ones of the bearing surfaces at an opposite location to correspond in shape and position to an additional positioning channel of the lamp base and also comprises an elongate groove formed between adjacent ones of the bearing surfaces to correspond in shape and position to a positioning rib of the lamp base and also comprises an additional elongate groove formed between adjacent ones of the bearing surfaces at an opposite location to correspond in shape and position to an additional positioning rib of the lamp base.

* * * * *